US007168668B2

(12) United States Patent
Coyle

(10) Patent No.: US 7,168,668 B2
(45) Date of Patent: Jan. 30, 2007

(54) DAMAGE RESISTANT ANTENNA MOUNT

(75) Inventor: Kenneth J. P. Coyle, Prospect, KY (US)

(73) Assignee: Checkpoint Systems, Inc., Thorofare, NJ (US)

( * ) Notice: Subject to any disclaimer, the term of this patent is extended or adjusted under 35 U.S.C. 154(b) by 202 days.

(21) Appl. No.: 10/911,254

(22) Filed: Aug. 4, 2004

(65) Prior Publication Data

US 2006/0026797 A1 Feb. 9, 2006

(51) Int. Cl.
*E04G 3/00* (2006.01)
*H01Q 1/12* (2006.01)

(52) U.S. Cl. ..... 248/279.1; 343/891

(58) Field of Classification Search ..... 343/890, 343/891, 892, 897; 248/282.1, 279.1, 285.1; 16/29, 30, 33, 34, 280–282, 284
See application file for complete search history.

(56) References Cited

U.S. PATENT DOCUMENTS

| | | | |
|---|---|---|---|
| 3,604,006 | A | 9/1971 | Rogers |
| 3,952,364 | A | 4/1976 | Lautenschlaeger, Jr. |
| 3,999,246 | A | 12/1976 | Suska |
| 4,030,161 | A | 6/1977 | Loikitz |
| 4,073,508 | A | 2/1978 | George et al. |
| 4,228,561 | A | 10/1980 | Gwozdz |
| RE30,475 | E | 1/1981 | Heinze, Sr. |
| 4,334,697 | A | 6/1982 | Deweese |
| 4,490,726 | A | 12/1984 | Weir |
| 4,513,475 | A | 4/1985 | Fenton |
| 4,619,304 | A | 10/1986 | Smith |
| 4,669,622 | A | 6/1987 | Bennett |
| 4,806,044 | A | 2/1989 | Duckett |
| 4,828,425 | A | 5/1989 | Duckett |
| 4,929,023 | A | 5/1990 | Rasmussen |
| 5,056,193 | A | 10/1991 | Colamussi |
| 5,146,854 | A | 9/1992 | Poulos |
| 5,156,646 | A | 10/1992 | Alesso et al. |
| 5,277,462 | A | 1/1994 | Verzelli et al. |
| 5,530,992 | A | 7/1996 | Baermann |
| 5,673,459 | A | 10/1997 | Baghdasarian |
| 5,921,422 | A | 7/1999 | Hunter et al. |
| 6,072,664 | A | 6/2000 | Aoyagi et al. |

(Continued)

OTHER PUBLICATIONS

HardwareSource, Double Acting Spring Hinges, catalog; website: www.hardwaresource.com, Jun. 11, 2004.

(Continued)

*Primary Examiner*—Tuyet Vo
*Assistant Examiner*—Minh Dieu A
(74) *Attorney, Agent, or Firm*—Caesar, Rivise, Bernstein, Cohen & Pokotilow, Ltd.

(57) ABSTRACT

A damage resistant mount for an object is provided which includes a mounting plate, a first post having a first end and a second end, the first end rigidly attached and extending from the mounting plate, and a two-way, swinging, spring-loaded, self closing hinge disposed on the post. The hinge has an outside hinge leaf and an inside hinge leaf and the post is rigidly attached to the inside hinge leaf. A second post having a first and a second end is included where the first end is rigidly attached to and extends from the outside hinge leaf. An object mounting device is disposed on the second end of the second post.

21 Claims, 6 Drawing Sheets

U.S. PATENT DOCUMENTS

| | | | | |
|---|---|---|---|---|
| 6,092,614 | A | 7/2000 | Shin | |
| 6,123,646 | A | 9/2000 | Colassi | |
| 6,456,258 | B1 | 9/2002 | Bragg et al. | |
| 6,512,492 | B2 * | 1/2003 | Overton | 343/891 |
| 6,695,270 | B1 * | 2/2004 | Smed | 248/274.1 |
| 6,966,533 | B1 * | 11/2005 | Kalis et al. | 248/316.4 |
| 7,028,961 | B1 * | 4/2006 | Dittmer et al. | 248/278.1 |
| 2004/0262474 | A1 * | 12/2004 | Boks et al. | 248/276.1 |

OTHER PUBLICATIONS

Bommer, The Hardware Hut, catalog, ref. 2248, website: www.thehardwarehut.com, Jun. 11, 2004.

Bommer, Double Acting Spring Hinges—3000 series, pamphlet, p. SH-12 undated, Jun. 11, 2004.

* cited by examiner

DAMAGE RESISTANT ANTENNA MOUNT

BACKGROUND OF THE INVENTION

The present invention is generally directed to resilient mounts for minimizing damage to objects mounted thereto. More specifically, the present invention is directed to antenna mounts that provide for movement of an antenna mounted thereto when a load is applied such that damage is minimized and that provides for the antenna to move back into proper position when the load is removed.

Various antenna mounts are known. For example, U.S. Pat. No. 6,456,258 (Bragg et al.) teaches a spring loaded antenna mounting system. Adjustment of the antenna is provided in two orthogonal directions. A quick connect/disconnect system is also provided. The spring is not used for damage resistance.

U.S. Pat. No. 3,604,006 (Rogers) teaches an antenna mast structure for an aircraft. Protection against accidental damage is afforded by its construction. Essentially, this mast structure is designed to snap off at a specific location such that easy replacement is possible.

U.S. Pat. No. 5,673,459 (Baghdasarian) is directed to a deployment hinge apparatus for an antenna. Here, the invention is primarily for deployment of an antenna in a space environment. The functions of this device include actuating, damping (to avoid excessive stresses at the end of deployment), a positioning function, and a function of equalizing rates of opening of different deployable strcuctures.

Finally, U.S. Pat. No. 4,490,726 (Weir) is directed to a collapsible, rooftop, microwave antenna having a wind loading feature. The antenna has a cross-head theodolite-type mount, adjustable for azimuth and elevation, with a horizontal pivot that provides for axial displacement if the axial wind force exceeds a predetermined threshold force.

It would be desirable to provide an object or antenna mount that provides for movement in one or more planes such that when the antenna or object that is mounted to the mount is caused to move, for example, due to being struck by another object, the mount provides for movement of the object or antenna, but then brings that object or antenna back substantially into its initial position. It would be desirable for such a mount to be inexpensive and easily constructed from non-custom components.

All references cited herein are incorporated herein by reference in their entireties.

BRIEF SUMMARY OF THE INVENTION

In a first embodiment of the present invention, a damage resistant mount for an object is provided that includes a first two-way, swinging, spring-loaded, self closing hinge where the hinge has an outside hinge leaf, a central hinge leaf, and an inside hinge leaf. A first post having a first and a second end is provided where the first end is rigidly attached to and extends from the outside hinge leaf. A second two-way, swinging, spring-loaded, self closing hinge is disposed on the second end of the first post in a perpendicular position relative to said first hinge. The second hinge also has an outside hinge leaf, a central hinge leaf, and an inside hinge leaf. The second end of the first post is rigidly attached to the inside hinge leaf. A second post having a first end and a second end is provided where the first end is rigidly attached to and extends from the outside hinge leaf of said second hinge. An object mounting device is disposed on the second end of said third post.

The first and second two-way, swinging, spring-loaded, self closing hinges may each have a first hinge barrel connected between the inside hinge leaf and a central hinge leaf and a second hinge barrel connected between the central hinge leaf and the outside hinge leaf. At least one of the posts may be extendible, for example, telescopically extendible.

The object mounting device may include a device to provide for horizontal adjustment of an object attached to the mounting device or to provide for vertical adjustment of an object attached to the mounting device or to provide for both horizontal and vertical adjustment of an object attached to the mounting device.

In another embodiment, a damage resistant mount for an object is provided which includes a mounting plate, a first post having a first end and a second end, the first end rigidly attached and extending from the mounting plate, and a two-way, swinging, spring-loaded, self closing hinge disposed on the second end of the post. The hinge has an outside hinge leaf and an inside hinge leaf The second end of the first post is rigidly attached to the inside hinge leaf. A second post having a first and a second end is included. The first end is rigidly attached to and extends from the outside hinge leaf. An object mounting device is disposed on the second end of the second post.

The two-way, swinging, spring-loaded, self closing hinge may include a first hinge barrel connected between the inside hinge leaf and a central hinge leaf and a second hinge barrel connected between the central hinge leaf and the outside hinge leaf. At least one of the first and second posts may be extendible, for example, telescopically extendible. The object mounting device may include a device to provide for horizontal adjustment of an object attached to the mounting device and/or a device to provide for vertical adjustment of an object attached to the mounting device.

In an alternate embodiment of the present invention, a damage resistant mount for an object is provided which includes a mounting plate and a first post having a first end and a second end. The first end is rigidly attached to and extends from the mounting plate. A first two-way, swinging, spring-loaded, self closing hinge is disposed on the second end of the first post. The first hinge includes an outside hinge leaf, a central hinge leaf, and an inside hinge leaf. The second end of the first post is rigidly attached to the inside hinge leaf of the first hinge. A second post having a first and a second end is also included where the first end is rigidly attached to and extends from the outside hinge leaf. A second two-way, swinging, spring-loaded, self closing hinge is disposed on the second end of the second post where the second hinge also includes an outside hinge leaf, a central hinge leaf, and an inside hinge leaf. The second end of the second post is rigidly attached to the inside hinge leaf of the second hinge. A third post has a first end and a second end where the first end is rigidly attached to and extends from the outside hinge leaf of the second hinge. An object mounting device is disposed on the second end of the third post. Again, the two-way, swinging, spring-loaded, self closing hinge preferably includes a first hinge barrel connected between the inside hinge leaf and a central hinge leaf and a second hinge barrel connected between the central hinge leaf and the outside hinge leaf.

In other embodiments of the present invention, the damage resistant mount is directed to substantially the same mount, but is specifically directed to a mount for an antenna.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
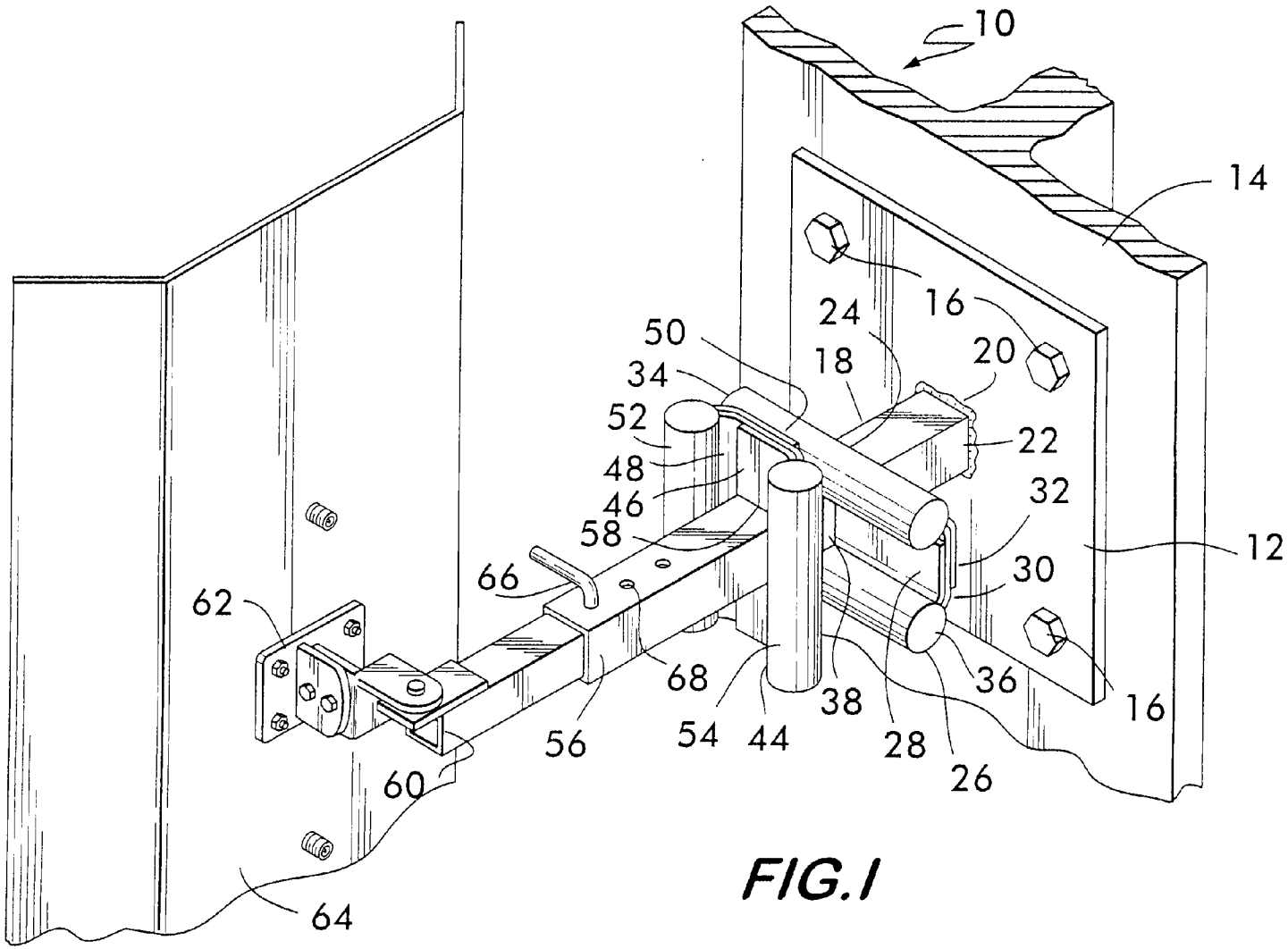
FIG. 1 is an isometric view of a damage resistant antenna mount in accordance with one preferred embodiment of the present invention.

Referring now to the drawings, wherein like part numbers refer to like elements throughout the several views, there is shown in FIG. 1 a damage resistant antenna mount 10 in accordance with one preferred embodiment of the present invention. The damage resistant antenna mount 10 includes a mounting plate 12 for attachment of the antenna mount 10 to a wall, beam or other structure 14. The mounting plate 12 may be mounted to the wall beam or other structure 14 using, for example, bolts 16 placed in through holes in the mounting plate 12. A first post 18 extends from the mounting plate 12. The first post 18 has a first end 22 and a second end 24. The first end 22 of the first post 18 is integral to the mounting plate 12. For example, the first post 18 may be welded to the mounting plate (see welds 20). Alternatively, the mounting plate 12 and first post 18 may be a single integral structure, for example, a single molded or machined structure.

Attached to the second end 24 of the first post is a first two-way, swinging, spring-loaded, self closing hinge 26. A hinge 26 of this type is a commonly available hinge which is sometimes called a double acting spring hinge. Typically, hinges of this type are used as industrial door hinges, for example, as hinges for doors between a kitchen and dining room at a restaurant. Hinges 26 of this type are commonly available from hardware sources such as McMaster-Carr Corporation and are manufactured by various manufacturers. For example, the 3000 Series of Double Acting Hinges by Bommer Industries, Inc. of Landrum, S.C. is appropriate for use in the present invention.

The hinge 26 basically includes an outside hinge leaf 28, a central hinge leaf 30, an inside hinge leaf 32, a first hinge barrel 34 and a second hinge barrel 36. The inside hinge leaf 32 is rigidly connected to the second end 24 of the first post 18. The first hinge barrel 34 is connected between the inside hinge leaf 32 and the central hinge leaf 30. The second hinge barrel 36 is connected between the central hinge leaf 30 and the outside hinge leaf 30. A second post 38 is included having a first end 40 and a second end 42. The first end 42 is rigidly attached to and extends from the outside hinge leaf 28 of the first hinge 26.

In operation of the hinge 26, the hinge 26 is spring loaded such that it self closes to the position as shown in FIG. 1. That is, the inside hinge leaf 32, the central hinge leaf 30 and the outside hinge leaf 28 are essentially stacked upon each other in its equilibrium position.

A second two-way, swinging, spring-loaded, self closing hinge 44 is disposed on the second end 42 of the second post 38 in a perpendicular position to that of the first hinge 26. The second hinge 44 is preferably of identical or similar structure to that of the first hinge 26. The second hinge 44 also includes an outside hinge leaf 46, a central hinge leaf 48, an inside hinge leaf 50, a first hinge barrel 52 and a second hinge barrel 54. The first end 40 of the second post 38 is rigidly attached to the inside hinge leaf 50 of the second hinge 44. The first hinge barrel 52 is connected between the inside hinge leaf 50 and the central hinge leaf 48. The second hinge barrel 54 is connected between the central hinge leaf 48 and the outside hinge leaf 46. A third post 56 is included having a first end 58 and a second end 60. The first end 58 is rigidly attached to and extends from the outside hinge leaf 46 of the second hinge 44.

Again, in operation of the second hinge 44, the second hinge 44 is spring loaded such that it self closes to the position as shown in FIG. 1. That is, the inside hinge leaf 50, the central hinge leaf 48 and the outside hinge leaf 46 are essentially stacked upon each other in its equilibrium position.

Figure 2A:
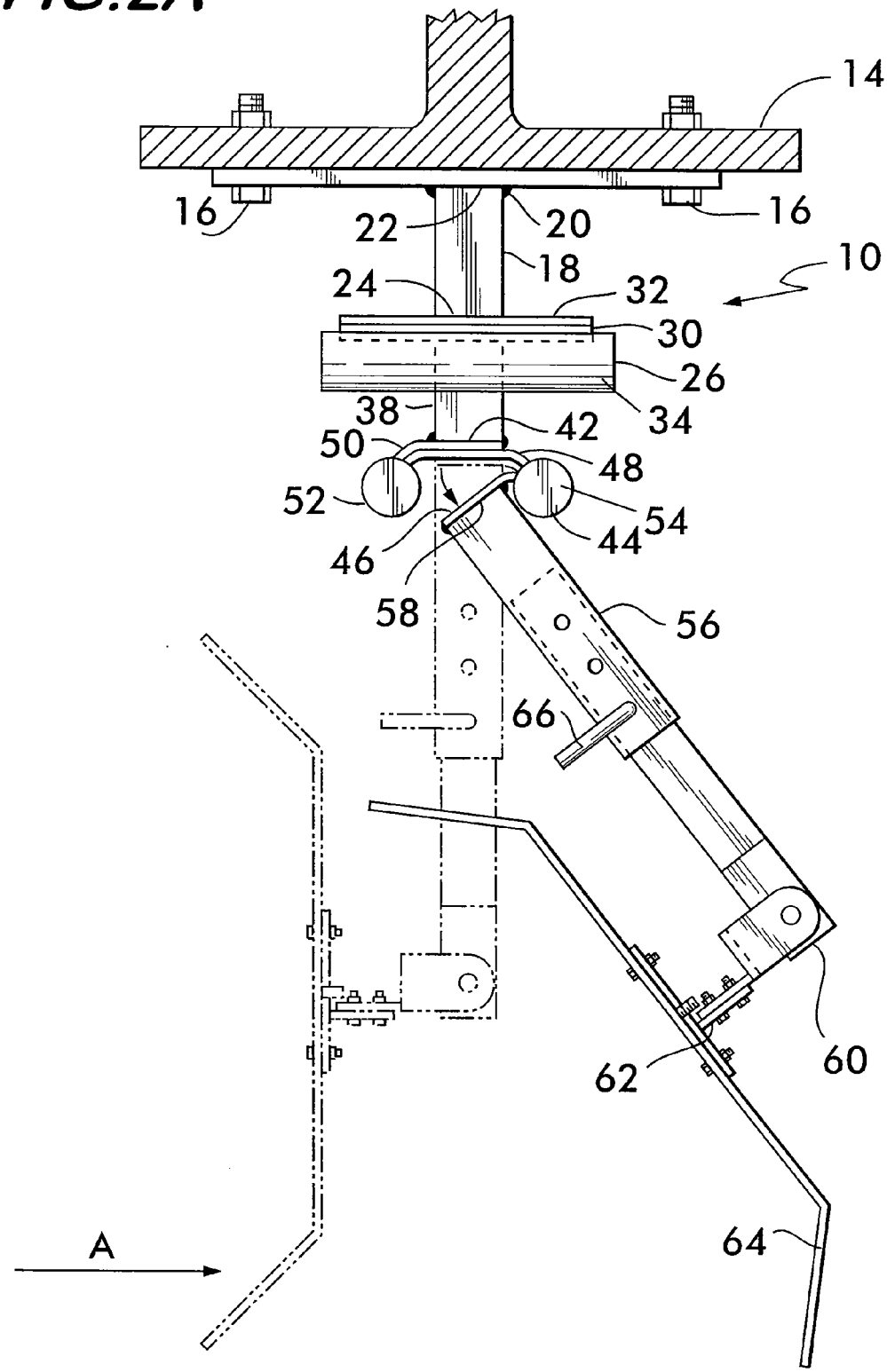
FIG. 2A is a top view of the damage resistant antenna mount of FIG. 1, showing the mount when a force is applied to the antenna from the left side of the drawing.
Figure 2B:
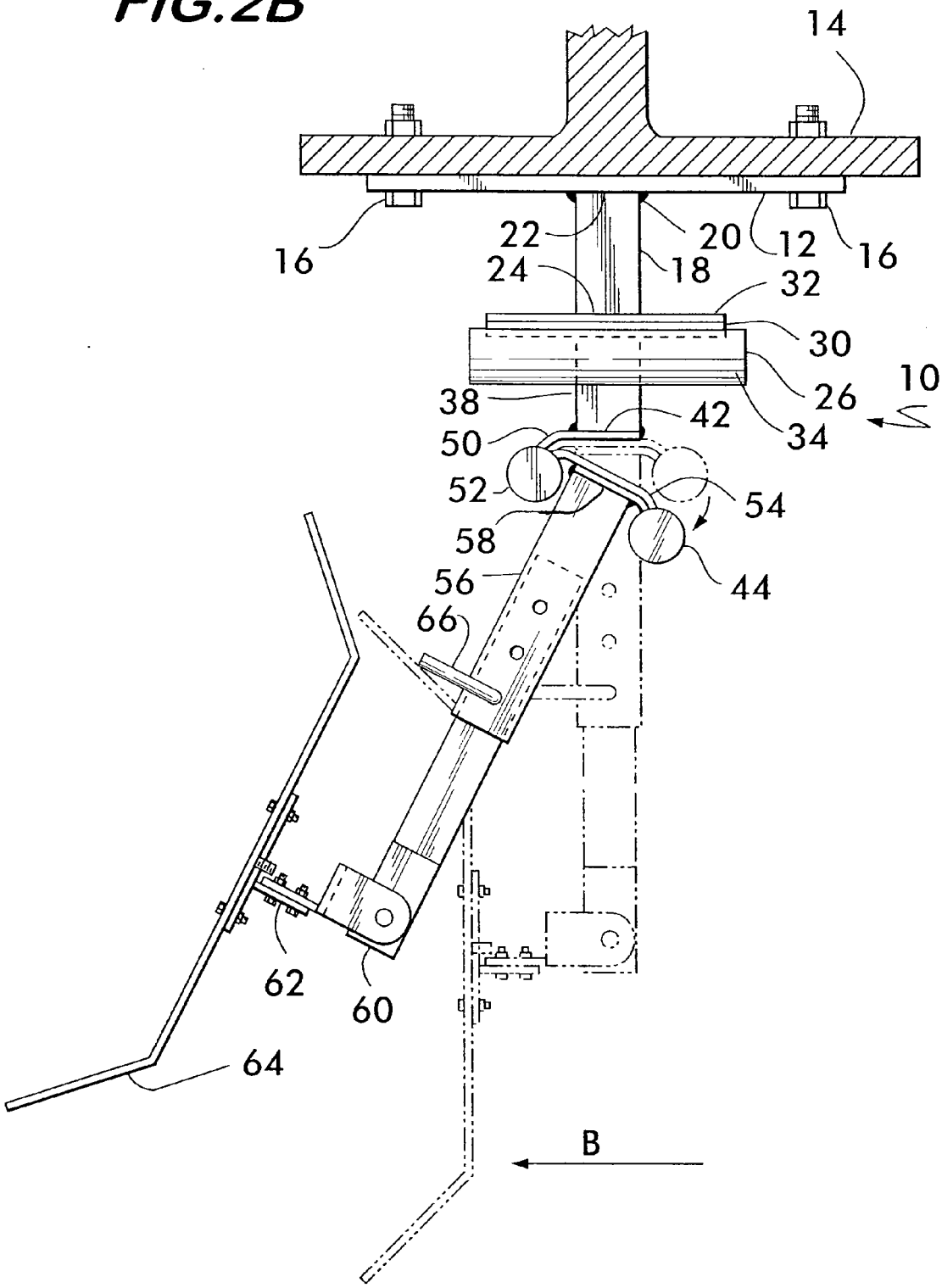
FIG. 2B is a top view of the damage resistant antenna mount of FIG. 1, showing the mount when a force is applied to the antenna from the right side of the drawing.

In operation, when a horizontal load is applied, directly or indirectly, to the third post 56, as shown as direction A in FIG. 2A, the outside hinge leaf 46 rotates with respect to the central hinge leaf 48 about the second hinge barrel 54 of the second hinge 44. The central hinge leaf 48 and the inside hinge leaf 50 essentially do not move. Likewise, when a horizontal load is applied, directly or indirectly, to the third post 56, as shown as direction B in FIG. 2B, the outside hinge leaf 46 together with the central hinge leaf 48 rotate with respect to the inside hinge leaf 32 about the first hinge barrel 52 of the second hinge 44.

Figure 3A:
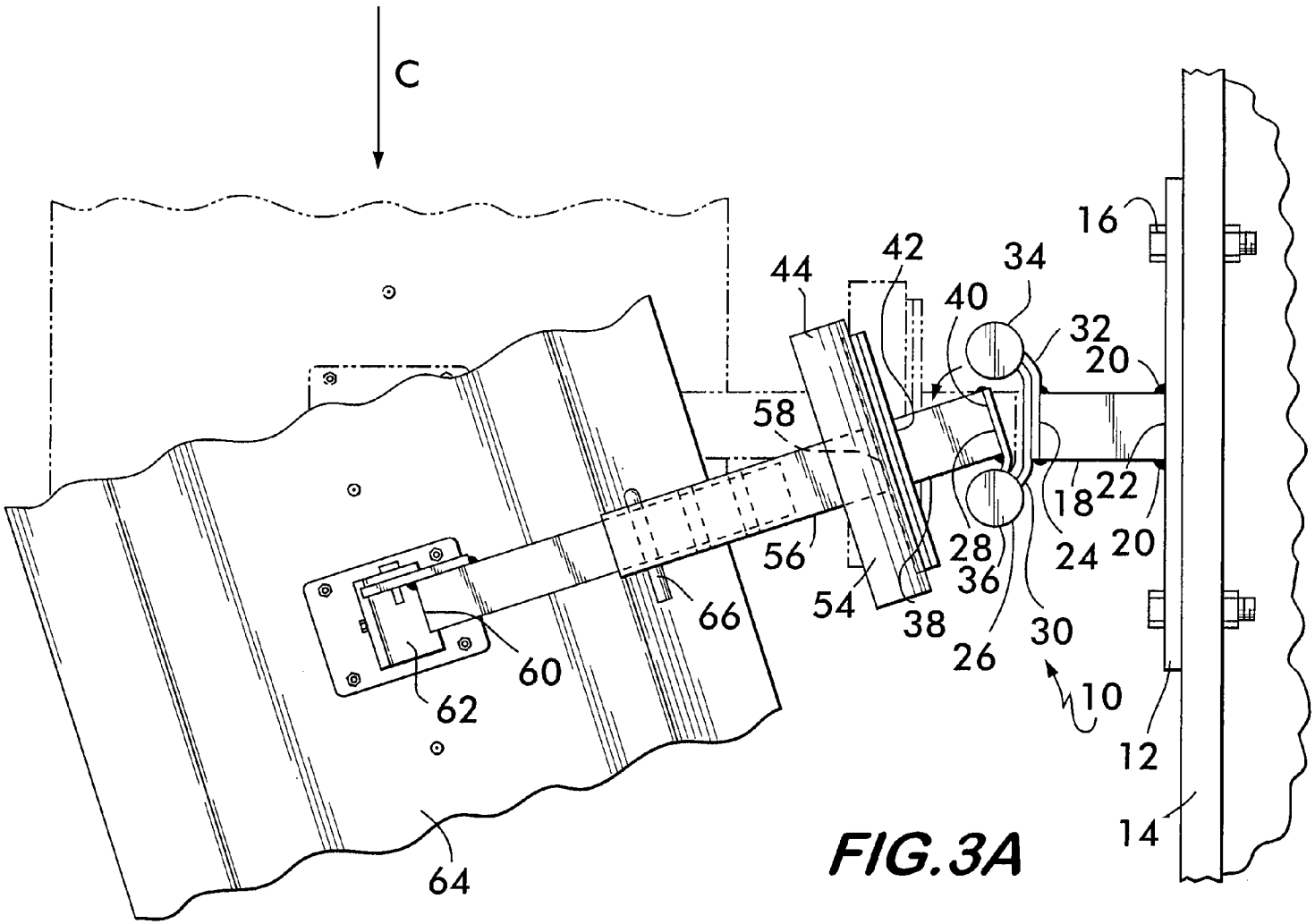
FIG. 3A is a side view of the damage resistant antenna mount of FIG. 1, showing the mount when a force is applied to the antenna from the top side of the drawing.
Figure 3B:
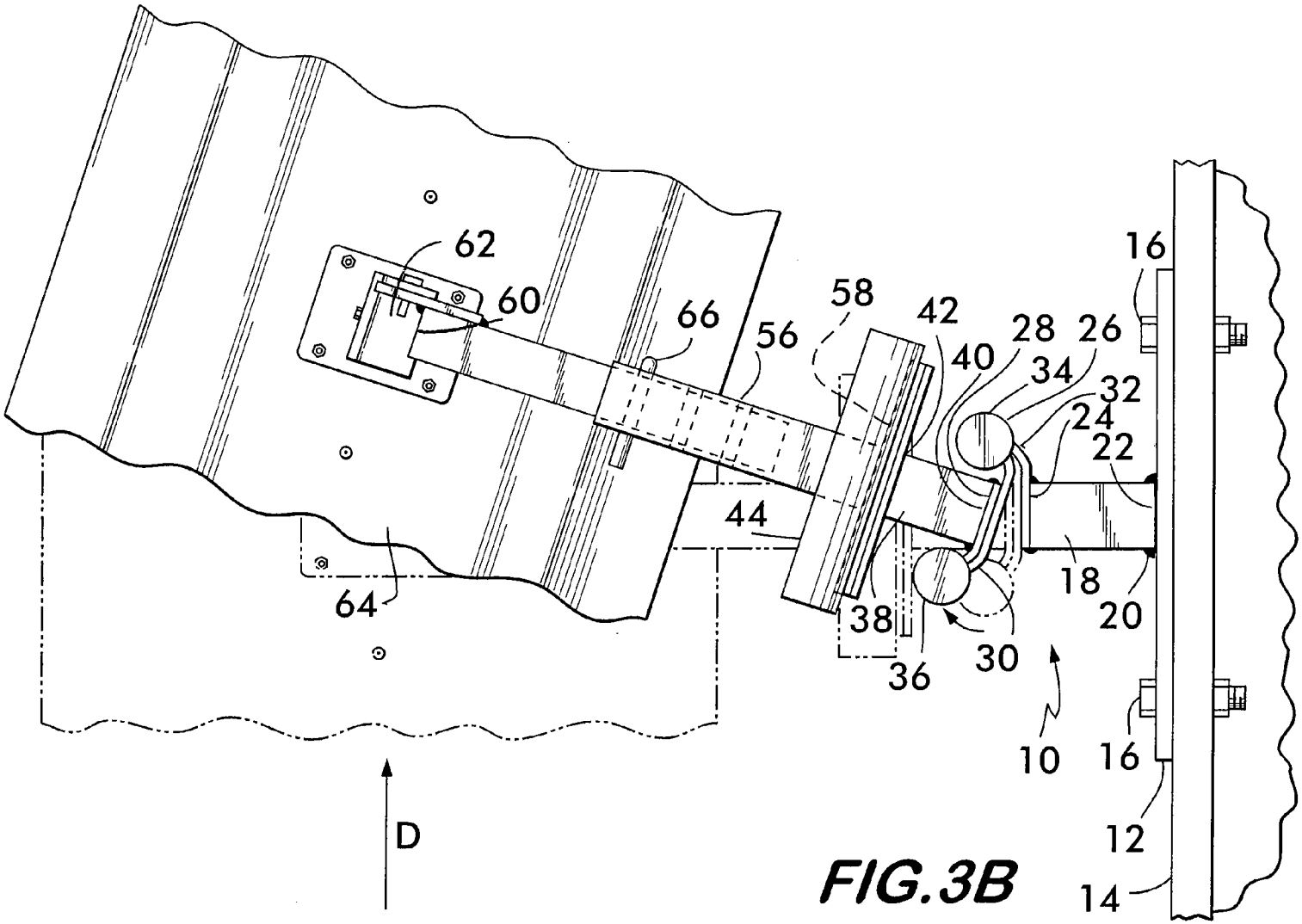
FIG. 3B is a side view of the damage resistant antenna mount of FIG. 1, showing the mount when a force is applied to the antenna from the bottom side of the drawing.

In operation, when a downwardly vertical load is applied, directly or indirectly, to the third post 56, as shown as direction C in FIG. 3A, the outside hinge leaf 28 of the first hinge 26 rotates with respect to the central hinge leaf 30 about the second hinge barrel 36 of the first hinge 26. The central hinge leaf 30 and the inside hinge leaf 32 essentially do not move. Likewise, when an upwardly vertical load is applied, directly or indirectly, to the third post 56, as shown as direction D in FIG. 3B, the outside hinge leaf 28 together with the central hinge leaf 30 rotate with respect to the inside hinge leaf 32 about the first hinge barrel 34 of the first hinge 26.

An antenna mounting device 62 is disposed on the second end 60 of the third post 56. This may be in substantially any suitable form. For example, the antenna may mount directly to a mounting plate at the second end 60 of the third post 56 (not shown). Alternatively, the mounting device may have a hinged end, as shown in all of the figures herein to provide for azimuth (horizontal) adjustment of an antenna 64 mounted thereto (or elevation (vertical), depending upon the axis of the damage resistant antenna mount 10, as mounted). A pair of hinges or substantially any other adjustment mechanism wherein an antenna may be mounted to a post is within the scope of an antenna mounting device of the present invention.

Additionally, any one or more of the first post 18, second post 38 or third post 56 may be extendible to provide for proper placement of an antenna 64 attached thereto. For example, as shown in the figures, the third post 56 may be in the form of two separate posts 56A and 56B wherein one of the posts 56B is telescopically extendible with respect to the other of the posts 56A. Posts 56A and 56B may be secured to one another using, for example, sets of aligned holes 68 in the posts 56A and 56B secured into which fit a pin 66.

The first hinge 26 and second hinge 44 may be welded or otherwise securely attached to the various posts 18, 38, 56.

Figure 4:
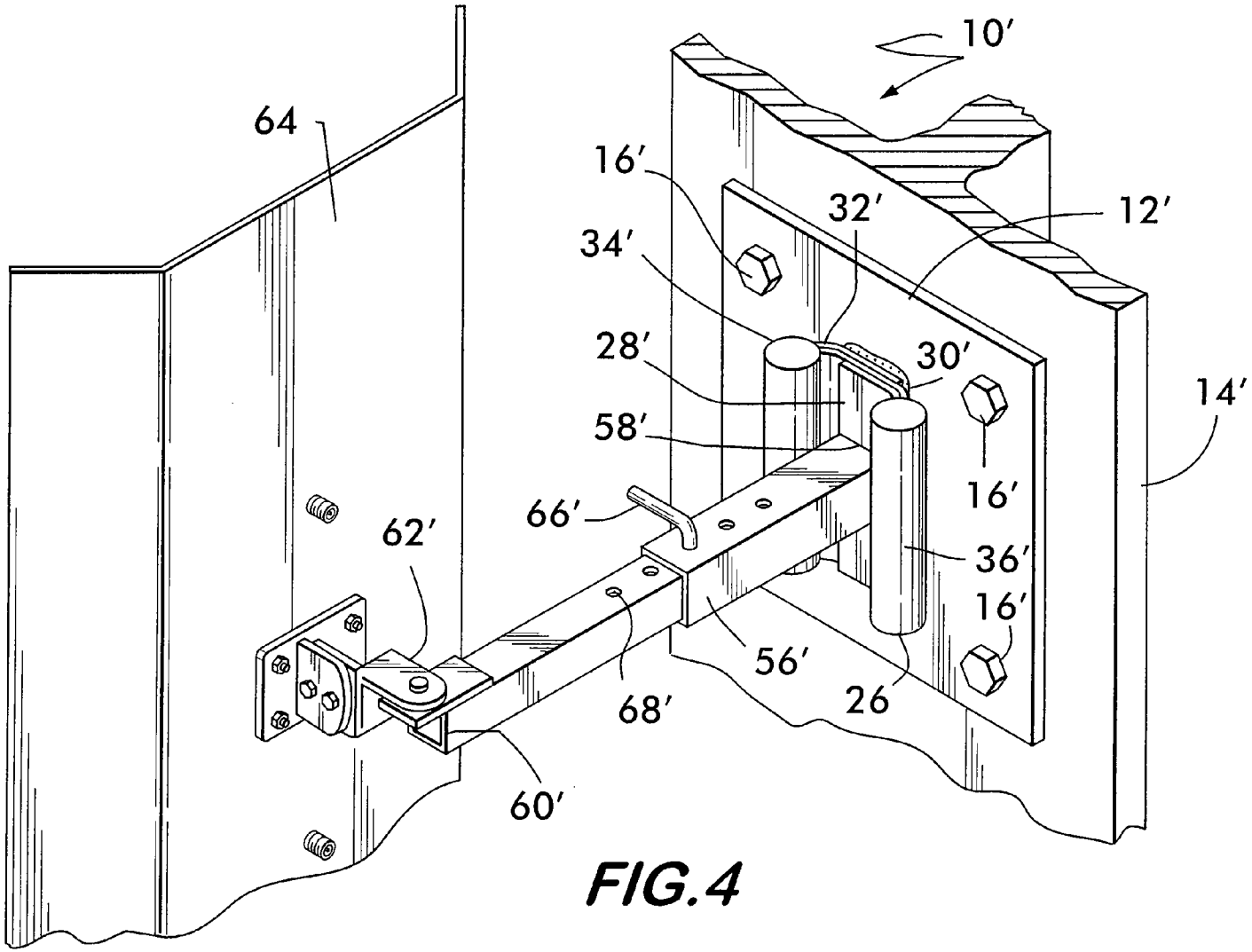
FIG. 4 is an isometric view of a damage resistant antenna mount in accordance with a second preferred embodiment of the present invention.

FIG. 4 shows a simplified version of the damage resistant antenna mount 10' which, as easily can be seen, includes substantially all of the same elements of the damage resistant antenna mount 10 of the first embodiment, except for the first post 18 (which is optional) second post 38, second hinge 44 and second post 56 of the mount 10. Here, for the sake of simplicity, the part numbers that are the same as that of the first embodiment are numbered here with an apostrophe after the number. For example, the mounting plate 12 of the first embodiment of the antenna mount 10 is designated mounting plate 12' in the second embodiment 10'. Here, the first hinge 28' may be mounted directly to the mounting plate 12' without the use of a first post. This antenna mount only provides for movement in one plane (for example, either a horizontal or vertical plane, depending upon its mounting orientation).

While the present mount is particularly suitable for mounting an antenna, the present invention is not intended to be limited to mounting only antennas. Substantially any object that may one desires to resiliently mount to avoid damage to the object or otherwise provide for movement in one or more planes is intend to be within the scope of the present invention.

While the invention has been described in detail and with reference to specific embodiments thereof, it will be apparent to one skilled in the art that various changes and modifications can be made therein without departing from the spirit and scope thereof.

What is claimed is:

1. A damage resistant mount for an object, comprising:

(A) a first two-way, swinging, spring-loaded, self closing hinge, said hinge comprising an outside hinge leaf, a central hinge leaf, and an inside hinge leaf;

(B) a first post having a first and a second end, said first end rigidly attached to and extending from said outside hinge leaf;

(C) a second two-way, swinging, spring-loaded, self closing hinge disposed on the second end of the first post in a perpendicular position relative to said first hinge; said hinge comprising an outside hinge leaf, a central hinge leaf, and an inside hinge leaf, said second end of said first post rigidly attached to said inside hinge leaf;

(D) a second post having a first end and a second end, said first end rigidly attached to and extending from said outside hinge leaf of said second hinge; and (E) an object mounting device disposed on the second end of said third post.

2. The damage resistant mount of claim 1, wherein the first and second two-way, swinging, spring-loaded, self closing hinges each comprise a first hinge barrel connected between said inside hinge leaf and a central hinge leaf and a second hinge barrel connected between said central hinge leaf and said outside hinge leaf.

3. The damage resistant mount of claim 1, wherein at least one of said posts is extendible.

4. The damage resistant mount of claim 3, wherein the at least one post that is extendible is telescopically extendible.

5. The damage resistant mount of claim 1, wherein the object mounting device includes a hinge to provide for horizontal adjustment of an object attached to the mounting device.

6. The damage resistant mount of claim 1, wherein the object mounting device includes a hinge to provide for vertical adjustment of an object attached to the mounting device.

7. The damage resistant mount of claim 1, wherein the object mounting device includes a hinge to provide for both horizontal and vertical adjustment of an object attached to the mounting device.

8. A damage resistant mount for an object, comprising:

(A) a mounting plate;

(B) a first post having a first end and a second end, said first end rigidly attached and extending from said mounting plate;

(C) a two-way, swinging, spring-loaded, self closing hinge disposed on the second end of the post; said hinge comprising an outside hinge leaf and an inside hinge leaf, said second end of said first post rigidly attached to said inside hinge leaf;

(D) a second post having a first and a second end, said first end rigidly attached and extending from said outside hinge leaf; and (E) an object mounting device disposed on the second end of said second post.

9. The damage resistant mount of claim 8, wherein the two-way, swinging, spring-loaded, self closing hinge comprises a first hinge barrel connected between said inside hinge leaf and a central hinge leaf and a second hinge barrel connected between said central hinge leaf and said outside hinge leaf.

10. The damage resistant mount of claim 8, wherein at least one of said posts is extendible.

11. The damage resistant mount of claim 10, wherein the at least one post that is extendible is telescopically extendible.

12. The damage resistant mount of claim 8, wherein the object mounting device a device to provide for horizontal adjustment of an object attached to the mounting device.

13. The damage resistant mount of claim 8, wherein the object mounting device includes a device to provide for vertical adjustment of an object attached to the mounting device.

14. The damage resistant mount of claim 8, wherein the object mounting device includes a hinge to provide for both horizonal and vertical adjustment of an object attached to the mounting device.

15. A damage resistant mount for an object, comprising:

(A) a mounting plate;

(B) a first post having a first end and a second end, said first end rigidly attached to and extending from said mounting plate;

(C) a first two-way, swinging, spring-loaded, self closing hinge disposed on the second end of the first post; said hinge comprising an outside hinge leaf, a central hinge leaf, and an inside hinge leaf, said second end of said first post rigidly attached to said inside hinge leaf of said first hinge;

(D) a second post having a first and a second end, said first end rigidly attached to and extending from said outside hinge leaf;

(E) a second two-way, swinging, spring-loaded, self closing hinge disposed on the second end of the second post in a perpendicular position relative to said first hinge; said hinge comprising an outside hinge leaf, a central hinge leaf, and an inside hinge leaf, said second end of said second post rigidly attached to said inside hinge leaf;

(F) a third post having a first end and a second end, said first end rigidly attached to and extending from said outside hinge leaf of said second hinge; and (G) an object mounting device disposed on the second end of said third post.

16. The damage resistant mount of claim 15, wherein the first and second two-way, swinging, spring-loaded, self closing hinges each comprise a first hinge barrel connected between said inside hinge leaf and a central hinge leaf and a second hinge barrel connected between said central hinge leaf and said outside hinge leaf.

17. The damage resistant mount of claim 15, wherein at least one of said posts is extendible.

18. The damage resistant mount of claim 17, wherein the at least one post that is extendible is telescopically extendible.

19. The damage resistant mount of claim 15, wherein the object mounting device includes a hinge to provide for horizontal adjustment of an object attached to the mounting device.

20. The damage resistant mount of claim 15, wherein the object mounting device includes a hinge to provide for vertical adjustment of an object attached to the mounting device.

21. The damage resistant mount of claim 15, wherein the object mounting device includes a hinge to provide for both horizonal and vertical adjustment of an object attached to the mounting device.

* * * * *